United States Patent [19]

Stecklein

[11] 4,212,582

[45] Jul. 15, 1980

[54] LINKAGE TO ALLOW INCREASED ANGULAR ROTATION OF BACKHOE BOOM

[75] Inventor: Gary L. Stecklein, Dubuque, Iowa

[73] Assignee: Deere & Company, Moline, Ill.

[21] Appl. No.: 926,555

[22] Filed: Jul. 20, 1978

[51] Int. Cl.[3] ..... E02F 3/00

[52] U.S. Cl. ..... 414/694; 414/685

[58] Field of Search ..... 414/685, 694, 680, 699

[56] References Cited

U.S. PATENT DOCUMENTS

| | | | |
|---|---|---|---|
| 2,529,338 | 11/1950 | Hoover | 414/685 |
| 2,995,261 | 8/1961 | Soyland et al. | 414/694 |
| 3,376,984 | 4/1968 | Long et al. | 414/694 |
| 3,703,973 | 11/1972 | Nilsson | 414/694 |
| 3,896,950 | 7/1975 | McCain | 414/694 |

*Primary Examiner*—Stephen G. Kunin
*Assistant Examiner*—Lawrence E. Williams

[57] ABSTRACT

A backhoe boom is pivotally connected to a swing frame for vertical movement relative thereto. A power extendable and retractable linkage is connected between the swing frame and the boom and includes a hydraulic actuator having one end pivotally connected to the boom and having its other end pivotally connected to respective first ends of a pair of links having respective second ends respectively pivotally connected to the boom and to the swing frame. The links make it possible for the actuator to position the boom in a raised transport position wherein a connection of an outer end of the boom with a dipperstick is located rearwardly of a transverse vertical plane extending through a connection of an inner end of the boom with the swing frame.

7 Claims, 6 Drawing Figures

LINKAGE TO ALLOW INCREASED ANGULAR ROTATION OF BACKHOE BOOM

BACKGROUND OF THE INVENTION

The present invention relates to a backhoe and more particularly relates to a backhoe constructed to enable its boom to be moved to a fully raised transport position wherein the weight of the boom and parts supported thereby are disposed close to the carrying vehicle.

U.S. Pat. No. 3,376,984 issued to Long et al on Apr. 9, 1968 discloses a backhoe having a boom which may be pivoted vertically about its connection with a swing frame, to a transport position extending partially above the swing frame so as to be close to a tractor carrying the backhoe. The boom is so pivoted by means of a hydraulic actuator having its opposite ends connected directly to the boom and to the swing frame such that the connection of the actuator with the boom passes from one side to the other or overcenter relative to a line of centers extending through the respective connections of the boom and actuator with the swing frame when the boom is pivoted between working and transport positions. This design has the disadvantage that the momentum of the boom is required to carry it overcenter when moving to its transport position and operators sometimes have difficulty in accomplishing this feat.

SUMMARY OF THE INVENTION

According to the present invention there is provided a novel backhoe construction for enabling the boom to be easily swung to a transport position adjacent the vehicle carrying the backhoe.

An object of the invention is to provide a novel power extendable and retractable linkage for achieving an increased degree of vertical swinging of a backhoe boom whereby the latter may be positioned in a transport position close to the vehicle carrying the backhoe.

A more specific object is to provide a power extendable and retractable linkage, as mentioned in the preceding object, which includes a hydraulic actuator having one end directly pivotally connected to the boom and having its other end pivotally connected to respective first ends of a pair of links having respective second ends respectively pivotally connected to the boom and to the swing frame.

These and other objects will become apparent from a reading of the ensuing description together with the appended drawings.

DESCRIPTION OF THE PREFERRED EMBODIMENT

Figure 1:
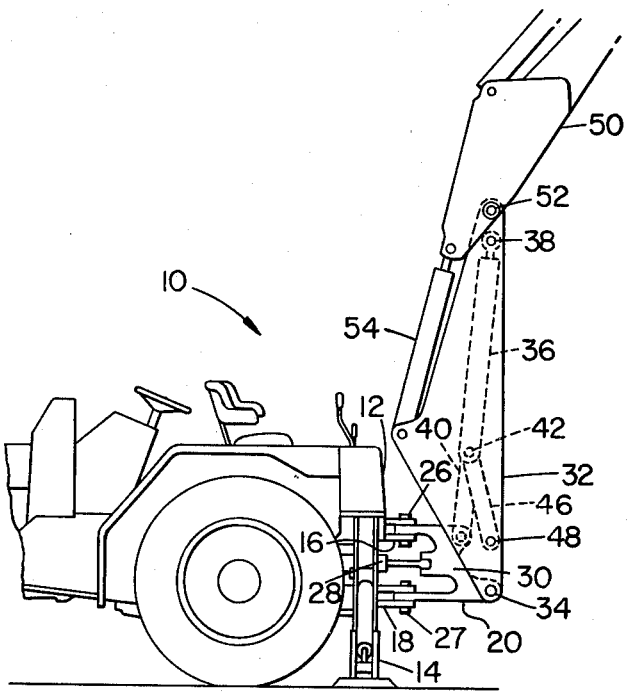
FIGS. 1–3 are left side elevational views of a backhoe, constructed according to a first embodiment of the invention, with the boom pivoted to the lower location of the swing frame, and respectively showing the backhoe boom in fully raised transport, intermediate and fully lowered positions.
Figure 2:
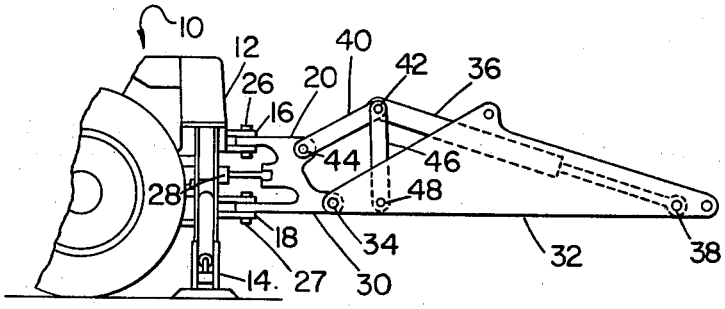
Figure 3:
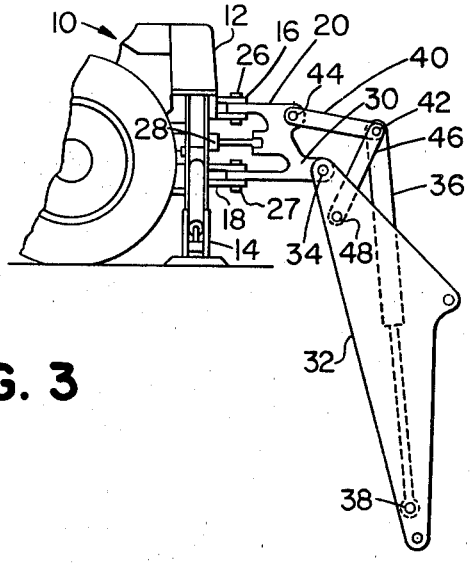

Referring now to the embodiment of the invention illustrated in FIGS. 1–3, therein is shown a tractor 10 having a transverse, backhoe support frame 12 connected thereto. Stabilizers 14 (only one shown) are provided at the opposite transverse ends thereof. At the rear end of the frame 12, there is provided upper and lower sets of horizontal plates 16 and 18. A swing frame 20 includes upper and lower arms 22 and 24 respectively, disposed between the upper and lower sets of plates 16 and 18 and received in vertically aligned holes provided in the arms and plates are upper and lower pins 26 and 27 about which the frame 20 is selectively swingable by means of a pair of swing cylinders 28 (only one shown) connected between the support and swing frames. The lower portion of the swing frame 20 has a rearward projection 30 to which the inner end of a backhoe boom 32 is attached by a horizontal transverse pivot pin 34 about which the boom 32 is selectively vertically swingable, in a manner to be presently described, between a fully raised transport position, as illustrated in FIG. 1, and a fully lowered working position, as illustrated in FIG. 3.

For the purpose of moving the boom 32 between its extreme positions, there is provided a power-extendable and retractable linkage defined by a telescopic or extendable and retractable hydraulic actuator 36 having its rod end directly pivotally connected to the boom 32, as at 38, and having its cylinder end connected to the swing frame by means of a first link 40 having a first end pivotally connected to the cylinder end, as at 42, and having a second end pivotally connected to the frame 20, at a location above and forwardly of the pin 34, as at 44. A second link 46 has a first end also pivoted to the cylinder end at 42 and has a second end pivotally connected to the boom 32 at a location spaced from but adjacent to the pin 34, as at 48. It is here noted that for some constructions it may be desirable to connect the link 46 to the link 40 at some point intermediate the ends of the latter.

As can be seen in FIG. 1, a dipperstick 50 is pivotally connected, as at pin 52, to the outer end of the boom 32 and a hydraulic actuator 54 is connected between the boom 33 and the dipperstick 50 for selectively swinging the dipperstick 50 about the pin 52.

Figure 4:
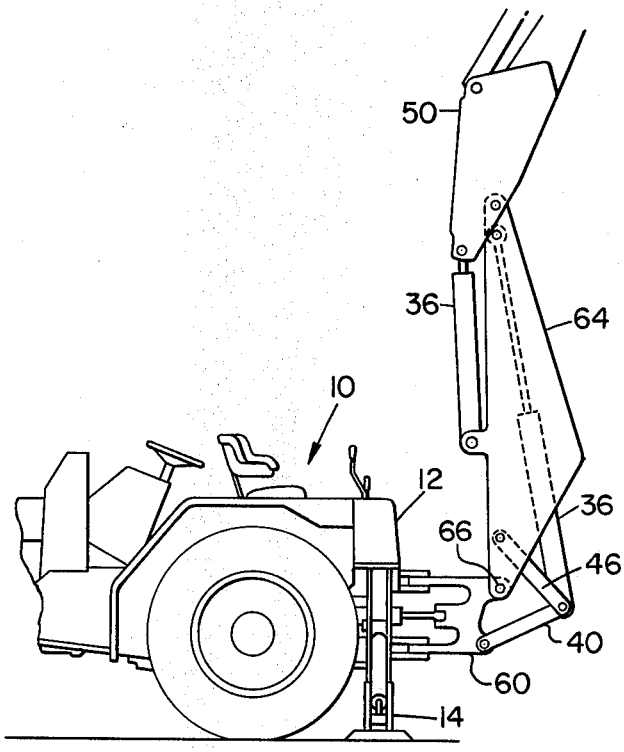
FIGS. 4–6 are left side elevational views of a backhoe, constructed according to a second embodiment of the invention, with the boom pivoted to an upper location of the swing frame, and respectively showing the backhoe boom in fully raised, intermediate and fully lowered positions.
Figure 5:
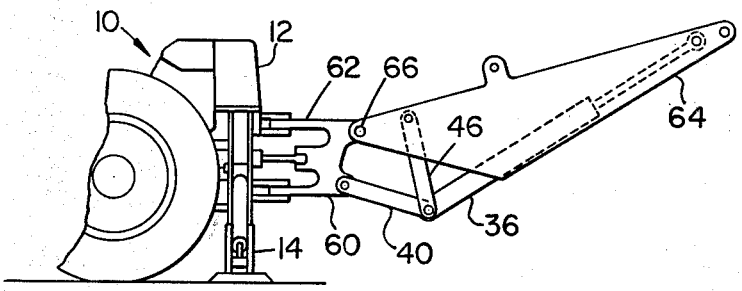
Figure 6:
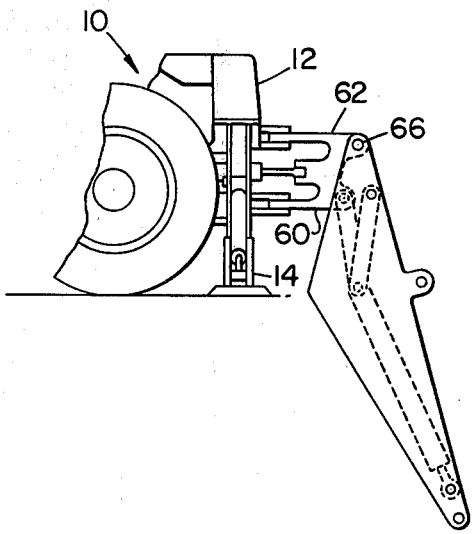

Referring now to FIGS. 4–6, there is illustrated a tractor and backhoe combination which differs from that illustrated in FIGS. 1–3 only in the area of the swing frame and boom. Consequently, many of the parts illustrated in FIGS. 4–6 are the same as those illustrated in FIGS. 1–3 and for the sake of clarity and brevity they are given the same reference numerals and are not described in much detail.

Thus, in FIGS. 4–6 there is shown a swing frame 60 mounted on the support frame 12 for swinging about the vertical axis defined by the pins 26 and 27. The upper portion of the swing frame 60 has a rearward projection 62 to which an inner end of a boom 64 is pivotally connected by means of a horizontal transverse pin 66 for vertical swinging movement between a fully raised transport position, shown in FIG. 4, and a fully lowered working position, shown in FIG. 6.

It will be appreciated from a comparison of FIGS. 1 and 4 that the frame 60 and boom 64 of FIG. 4 are essentially just the frame 20 and boom 32 of FIG. 1 turned upside down with the boom 32 modified to permit the actuator 54 to be connected to the top thereof.

The operation of the two embodiments respectively illustrated in FIGS. 1–3 and FIGS. 4–6 is essentially the same in that the actuator 36 works together with the links 40 and 46 to effect a greater degree of vertical swinging of the respective booms 32 64 than would be possible with the actuator 36 alone as is conventional in the art. This greater degree of vertical swinging is important as it permits the respective booms 32 and 64 and other backhoe members supported from the other ends thereof to be brought closer to the rear end of the tractor 10 for transport than is possible with the actuator alone thus resulting in a more stable tractor-backhoe combination during transport.

I claim:

1. In a backhoe including an upright, transverse support frame, a swing frame connected to one side of the support frame for pivoting about a vertical axis to opposite sides of a centered position, a backhoe boom having one end connected to the swing frame for vertical pivoting movement about a first horizontal axis which extends transversely, when the swing frame is in its centered position, and is spaced beyond the vertical axis from the one side of the support frame and having an opposite end pivotally connected to a dipperstick for allowing relative vertical pivoting movement between the boom and dipperstick about a second axis extending parallel to the first axis and spaced beyond the vertical axis from the one side of the support frame; a first telescopic hydraulic actuator connected between the swing frame and the boom for selectively pivoting the latter vertically through approximately 165° between extreme raised and lowered positions upon being telescoped between first and second extreme positions thereof, and a second telescopic hydraulic actuator connected between the boom and dipperstick for effecting relative pivotal movement therebetween, the improvement residing in the manner of connecting the first actuator between the swing frame and boom and comprising: said actuator having a first end directly pivotally connected to the boom; first and second links being pivotally interconnected to each other and at least one of the links also being pivotally interconnected to a second end of the first actuator, and said first and second links having respective ends respectively pivotally connected to the swing frame at a location spaced vertically from the first axis, and to the boom at a location spaced from but adjacent to the first axis; and said first and second links and said first actuator being so arranged relative to each other and the boom that when the actuator is in its first extreme position the second horizontal transverse axis will be located toward the support frame at least as far as a vertical transverse plane passing through the first horizontal transverse axis and when the actuator is in its second extreme position a line drawn through the respective ends of the first and second links will approximately pass through the first horizontal transverse axis.

2. The backhoe defined in claim 1 wherein the first horizontal transverse axis is located below the end of the first link at a location spaced farther away from the support frame than is the end of the first link.

3. The backhoe defined in claim 2, wherein opposite ends of the first link and of the first actuator are approximately in alignment when the actuator is in its first extreme position.

4. The backhoe defined in claim 1 wherein the first horizontal transverse axis is located above the second end of the first link at a location spaced farther away from the support frame than is the end of the first link.

5. The backhoe defined in claim 4, wherein opposite ends of the first link and of the first actuator are approximately in alignment when the actuator is in its second extreme position.

6. The backhoe defined in claim 1 wherein opposite ends of the first link and of the first actuator are approximately in alignment when the actuator is in one of its first and second extreme positions.

7. The backhoe defined in claim 1 wherein the first and second links are located such that, for any position of the boom, first and second lines respectively passing through opposite ends of the links will pass on opposite sides of the first horizontal transverse axis.

* * * * *